US012729917B2

(12) United States Patent
McMillan et al.

(10) Patent No.: US 12,729,917 B2
(45) Date of Patent: Sep. 8, 2026

(54) MOVABLE HEAT PIPE HEAT SINK DEVICE CONFIGURED TO MOVE INTO AND OUT OF CONTACT WITH AN APPARATUS

(71) Applicant: The Boeing Company, Arlington, VA (US)

(72) Inventors: Daniel James McMillan, Edmonds, WA (US); Elizaveta Leonardovna Manevich, Auburn, WA (US); Austin Brady Ball, Tukwila, WA (US); Silas Lawton Studley, Lake Forest Park, WA (US)

(73) Assignee: THE BOEING COMPANY, Arlington, VA (US)

( * ) Notice: Subject to any disclaimer, the term of this patent is extended or adjusted under 35 U.S.C. 154(b) by 246 days.

(21) Appl. No.: 18/527,871

(22) Filed: Dec. 4, 2023

(65) Prior Publication Data

US 2025/0180297 A1 Jun. 5, 2025

(51) Int. Cl.
*F28D 15/02* (2006.01)
*F28D 21/00* (2006.01)

(52) U.S. Cl.
CPC ..... *F28D 15/0208* (2013.01); *F28D 15/0275* (2013.01); *F28D 2021/004* (2013.01)

(58) Field of Classification Search
CPC ..... F28D 15/0208; F28D 15/0275; F28D 2021/004; F28F 2013/005; F28F 2013/008
See application file for complete search history.

(56) References Cited

U.S. PATENT DOCUMENTS 4,345,642 A * 8/1982 Ernst ..... F28F 13/00 165/104.19
5,925,929 A * 7/1999 Kuwahara ..... H05K 7/20936 257/722
5,974,556 A * 10/1999 Jackson ..... G06F 1/3203 327/512
6,069,791 A * 5/2000 Goto ..... G06F 1/203 361/679.55
6,084,769 A * 7/2000 Moore ..... G06F 1/203 361/679.52
6,118,654 A * 9/2000 Bhatia ..... G06F 1/1632 361/679.55
6,181,553 B1 * 1/2001 Cipolla ..... G06F 1/203 361/689
6,191,943 B1 * 2/2001 Tracy ..... G06F 1/203 361/679.55
6,313,987 B1 * 11/2001 O'Connor ..... G06F 1/1632 165/104.33

(Continued)

*Primary Examiner* — Travis Ruby
(74) *Attorney, Agent, or Firm* — COATS & BENNETT, PLLC

(57) ABSTRACT

A cooling assembly to transfer heat away from an apparatus. The cooling assembly includes a heat sink and heat pipes that are connected to and that extend outward from the heat sink. The heat pipes include a first section that extends outward from the heat sink and that is shaped to be inserted into the apparatus, and a second section that is embedded within the heat sink. An actuation mechanism is configured to move the heat sink and the heat pipes in a first direction to contact the heat pipes with the apparatus and in an opposing second direction to remove the heat pipes from contact with the apparatus. A cooling system includes one or more apparatuses, heat sinks, and heat pipes.

20 Claims, 10 Drawing Sheets

(56) References Cited

U.S. PATENT DOCUMENTS

| | | | | |
|---|---|---|---|---|
| 6,643,132 | B2 * | 11/2003 | Faneuf | H05K 7/20809 165/80.4 |
| 6,674,643 | B2 * | 1/2004 | Centola | H05K 7/20672 361/720 |
| 7,403,384 | B2 * | 7/2008 | Pflueger | H05K 7/20545 361/679.48 |
| 7,839,640 | B2 * | 11/2010 | Hayashi | G06F 1/20 165/80.4 |
| 11,060,484 | B2 | 7/2021 | Silkey et al. | |
| 2004/0050535 | A1 * | 3/2004 | Malone | F28D 15/0275 165/185 |
| 2010/0132925 | A1 * | 6/2010 | Lewis | H01L 23/427 165/104.26 |
| 2021/0382532 | A1 * | 12/2021 | Nicholas | G06F 1/203 |

* cited by examiner

MOVABLE HEAT PIPE HEAT SINK DEVICE CONFIGURED TO MOVE INTO AND OUT OF CONTACT WITH AN APPARATUS

TECHNOLOGICAL FIELD

The present disclosure relates generally to the field of heat management of an apparatus and, more specifically, to cooling assemblies and cooling systems having one or more heat sinks and heat pipes configured to move into contact with an apparatus for rapid cooling.

BACKGROUND

Different apparatuses such as manufacturing equipment, tooling (such as heated tooling), and others are required to be cooled during use. One manner of cooling an apparatus is through a heat sink. A heat sink is a passive device that transfers heat in the apparatus to a fluid medium, such as a fluid coolant or air. Heat sinks that transfer heat to the air often use fins with large surface areas to facilitate the transfer of the heat to the air. Heat sinks that use a fluid coolant can include complicated piping configurations to move the fluid in a manner to facilitate cooling.

In use, the heat sink is in contact with the apparatus to remove the heat therefrom. In a manufacturing setting, it can be difficult to position the heat sink in contact with the apparatus. For example, the apparatus may be positioned within a small space that does not have extra room for a heat sink. Heat sinks that are configured to contact the apparatus may be too small or otherwise not effective in removing the heat. Further, an apparatus can often move during use. For example, form blocks of a punch forming assembly move between open and closed positions when forming a composite stringer. It can be difficult to effectively position a heat sink relative to the apparatus while also allowing for the movement necessary for its operation.

An apparatus that is not cooled may reach elevated temperatures that are above normal operating conditions. The excessive heat can cause the apparatus to fail during use. Further, the excessive heat can damage the apparatus and reduce the life expectancy. The excessive heat can require additional maintenance and more frequent replacement which can reduce the efficiency of a manufacturing process and/or increase the cost of manufacturing.

SUMMARY

One aspect is directed to a cooling assembly to transfer heat away from an apparatus. The cooling assembly comprises a heat sink and heat pipes that are connected to and that extend outward from the heat sink. The heat pipes comprise a first section that extends outward from the heat sink and that is shaped to be inserted into the apparatus, and a second section that is embedded within the heat sink. An actuation mechanism is configured to move the heat sink and the heat pipes in a first direction to contact the heat pipes with the apparatus and in an opposing second direction to remove the heat pipes from contact with the apparatus.

In another aspect, the heat pipes are aligned in a straight row along the heat sink with each of the heat pipes mounted at a common vertical level within the heat sink.

In another aspect, the heat pipes comprise a first end in the first section and second end in the second section with the first end positioned vertically below the second end when the heat pipes are inserted into the apparatus.

In another aspect, thermal contact members are mounted to the first section of the heat pipes with the thermal contact members constructed from thermally conductive material.

In another aspect, the thermal contact members are positioned on an exterior of the heat pipes to prevent the heat pipes from directly contacting against the apparatus when the heat pipes are moved in the first direction.

In another aspect, thermal contact members are mounted to ends of the heat pipes at the first sections with the thermal contact members comprising: inner members that contact against the heat pipes; and outer members that are movably connected to and positioned outward from the inner members, and wherein the outer members are biased outward from the inner members.

In another aspect, each of the heat pipes comprises an equal shape and size.

In another aspect, the actuation mechanism is configured to move the heat sink and the heat pipes in a first plane to contact the heat pipes with the apparatus and remove the heat pipes from contract with the apparatus and in a second plane to index the heat sink and the heat pipes along a length of the apparatus.

In another aspect, the actuation mechanism moves the heat sink and the heat pipes along a first linear path in the first plane and along a second linear path in the second plane.

One aspect is directed to a cooling system comprising an apparatus comprising a body and pockets that extend into the body. A heat sink comprises one or more conduits to move a first fluid within an interior of the heat sink. Heat pipes are connected to and that extend outward from the heat sink with the heat pipes comprising a first end that extends outward from the heat sink and a second end positioned within the interior of the heat sink and vertically above the first end with the heat pipes further comprising an enclosed interior space that contains a working fluid. The heat sink and the heat pipes are configured to move between an engaged position and a disengaged position. The engaged position comprises the heat pipes inserted into the pockets causing the working fluid at the first end to evaporate and move towards the second end to cool the apparatus. The disengaged position comprises the heat pipes spaced away from the pockets causing the working fluid to condense and move towards the first end.

In another aspect, the heat pipes comprise a wick positioned within the interior space to facilitate movement of the working fluid from the second end towards the first end.

In another aspect, the heat pipes comprise thermal contact members mounted at the first ends with the thermal contact members comprising an adjustable outer member configured to contact against the apparatus when the first end is inserted into the pocket.

In another aspect, the thermal contact members are mounted on an exterior of the heat pipes to prevent the heat pipes from directly contacting the apparatus in the engaged position.

In another aspect, an actuation mechanism moves the heat sink and the heat pipes relative to the apparatus with the actuation mechanism moving the heat sink and the heat pipes as a unit relative to the apparatus between the engaged position with the first ends positioned in the apparatus and a disengaged position with the heat pipes spaced away from the apparatus.

In another aspect, each of the heat pipes comprises an identical shape and size.

One aspect is directed to a method of using a cooling system. The method comprises: moving a heat sink and heat pipes in a first direction and inserting the heat pipes that are spaced apart along the heat sink into pockets in an apparatus; transferring heat from the apparatus to the heat sink through the heat pipes while the heat pipes are inserted into the pockets; and moving the heat sink and the heat pipes in an opposing second direction and removing the heat pipes from the pockets.

In another aspect, the method further comprises compressing thermal contact members mounted on the heat pipes while inserting the heat pipes into the pockets.

In another aspect, the method further comprises positioning second ends of the heat pipes vertically above first ends of the heat pipes while the first ends of the heat pipes are inserted into the pockets.

In another aspect, the method further comprises moving fluid in the heat sink directly into contact with an exterior of the heat pipes that are mounted in the heat sink while the heat pipes are inserted into the pockets.

In another aspect, the method further comprises: translating the heat sink and the heat pipes a distance along a length of the apparatus; moving the cooling assembly in the first direction and inserting the heat pipes into additional pockets in the apparatus with the additional pockets spaced apart along the apparatus from the pockets; and transferring heat from the apparatus to the heat sink while the heat pipes are inserted into the additional pockets.

The features, functions and advantages that have been discussed can be achieved independently in various aspects or may be combined in yet other aspects, further details of which can be seen with reference to the following description and the drawings.

DETAILED DESCRIPTION

Figure 1:
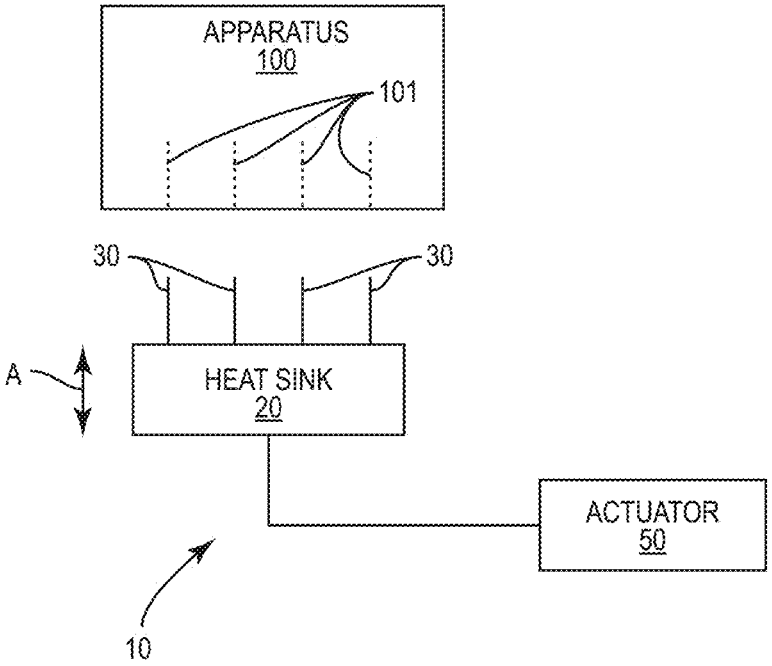
FIG. 1 is a schematic diagram of a cooling assembly that includes a heat sink, heat pipes, and an actuation mechanism.

FIG. 1 schematically illustrates a cooling assembly 10 configured to rapidly cool an apparatus 100. The cooling assembly 10 includes a heat sink 20 with one or more outwardly-extending heat pipes 30. The heat pipes 30 are configured to be inserted into corresponding pockets 101 in the apparatus 100. An actuation mechanism 50 is configured to move the heat sink 20 along a path illustrated by arrow A between an engaged position and a disengaged position. In the engaged position, the heat pipes 30 are inserted into the corresponding pockets 101 and contact against the apparatus 100 to enable rapid cooling. In the disengaged position, the heat pipes 30 are moved away from the apparatus 100.

The cooling assembly 10 enables rapid cooling for a variety of different types of apparatuses 100. In some examples, the apparatus is tooling used in a manufacturing process. In one specific example, the apparatus 100 is a form block of a punch forming assembly used during the manufacturing of composite aircraft members. In some examples, the apparatus 100 is an object that is being manufactured.

Figure 2A:
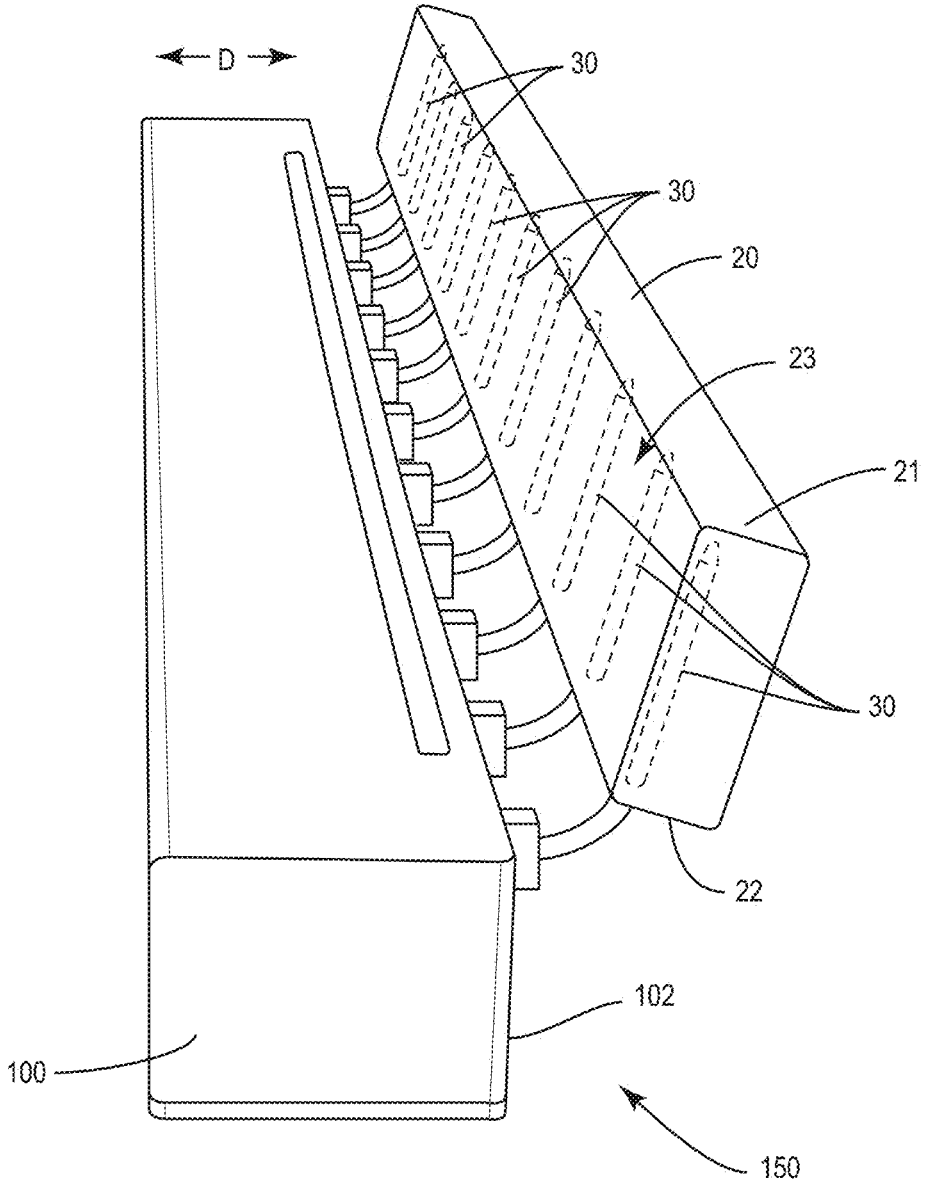
FIG. 2A is an end perspective view of heat pipes that extend outward from a heat sink and are inserted into an apparatus.
Figure 2B:
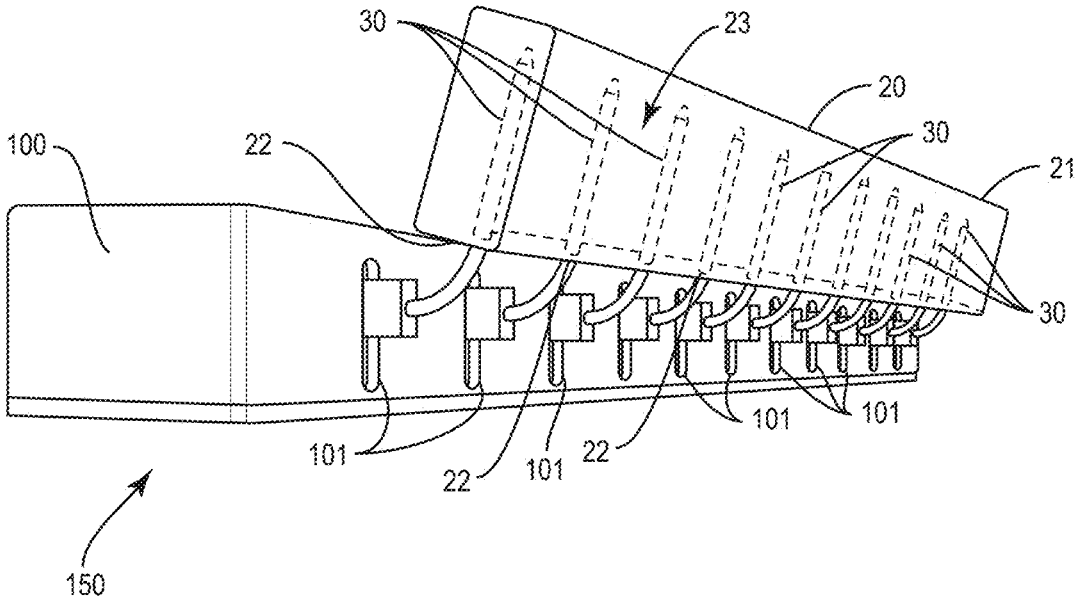
FIG. 2B is a side perspective view of the heat pipes and heat sink of FIG. 2A.

FIGS. 2A and 2B illustrate a cooling assembly 10 in an engaged position with the heat pipes 30 inserted into and in contact with an apparatus 100. The cooling assembly 10 includes a heat sink 20 and heat pipes 30. The heat pipes 30 extend outward from the heat sink 20 and are configured to be inserted into the apparatus 100. Heat from the apparatus 100 is transferred to the heat pipes 30 which are configured to then transfer to the heat sink 20.

The heat sink 20 includes a body 21 that can include a variety of shapes and sizes. In some examples as illustrated, the heat sink includes a substantially cuboid shape with substantially flat outer sides. In some examples, each of the heat pipes 30 extend outward from one side 22 of the heat sink 20. This facilitates use of heat pipes 30 with the same shape and size. In other examples, the heat pipes 30 include different shapes and/or sizes and extend outward from two or more sides 22 of the heat sink 20. An interior space 23 within the body 21 is configured to provide for the heat transfer from the heat pipes 30.

Figure 3:
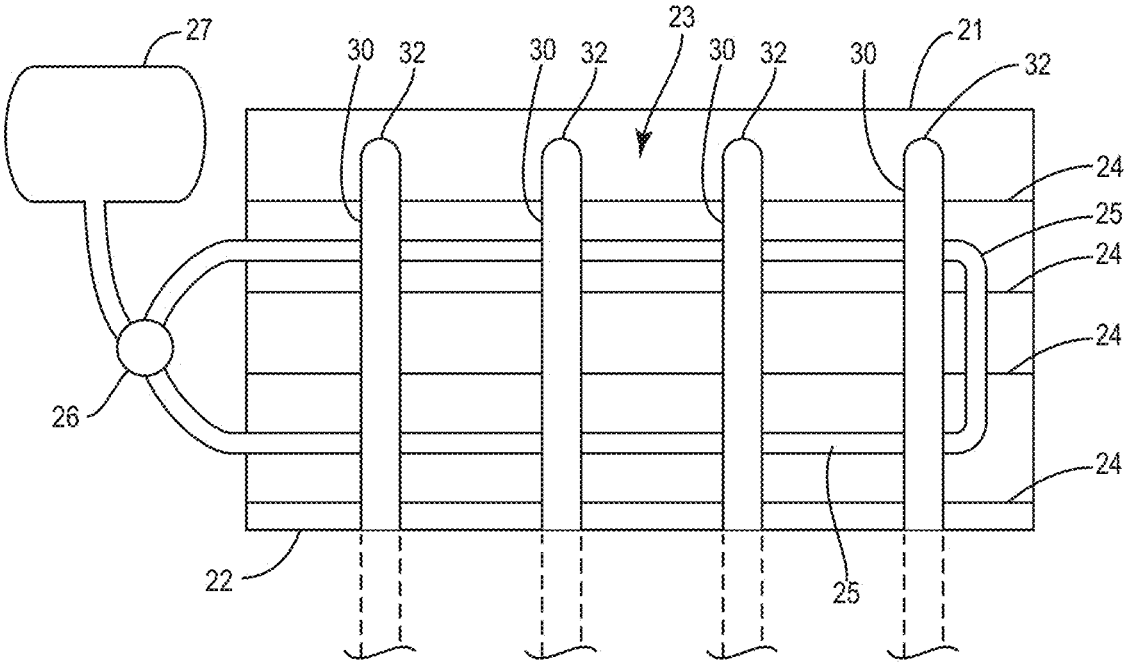
FIG. 3 is a schematic diagram of heat pipes extending into an interior space of a heat sink.

The interior space 23 can include a variety of different configurations. FIG. 3 schematically illustrates an interior space 23 that includes one or more contact members 24 and/or conduits 25. The contact members 24 contact against and conduct the heat away from the heat pipes 30. Examples of contact members 24 include but are not limited to plates, tubes, and fins. The conduits 25 are configured to move a fluid through the interior space 23. In some examples, the conduits 25 are formed between the contact members 24 with the fluid contacting directly against the heat pipes 30. Other examples as illustrated in FIG. 3 include the conduits 25 being tubes with outer walls that contain the fluid. Conduits 25 can be arranged to move the fluid through the interior space 23 in various manners, such as a single pass, double pass, etc. In some examples, a pump 26 is configured to move the fluid through the conduits 25. In other examples, the fluid moves without a pump such as by gravity. In some examples, the conduits 25 are fully contained within the interior space 23. In other examples, fluid is stored in an external reservoir 27 and then pumped through the interior space 23. A variety of different fluids can be used including but not limited to water, deionized water, glycol, and various dielectric fluids.

The heat pipes 30 are connected to and extend outward from the heat sink 20. The heat pipes 30 are configured to transfer heat from the apparatus 100 to the heat sink 20 in a relatively short time period thus enabling rapid cooling of the apparatus 100. The heat pipes 30 include a contained working fluid. The heat transfer occurs by thermal energy from the apparatus 100 being absorbed when the working fluid changes state into a gas within the heat pipe 30. The heat is then released when the gas changes state back to a fluid.

Figure 4:
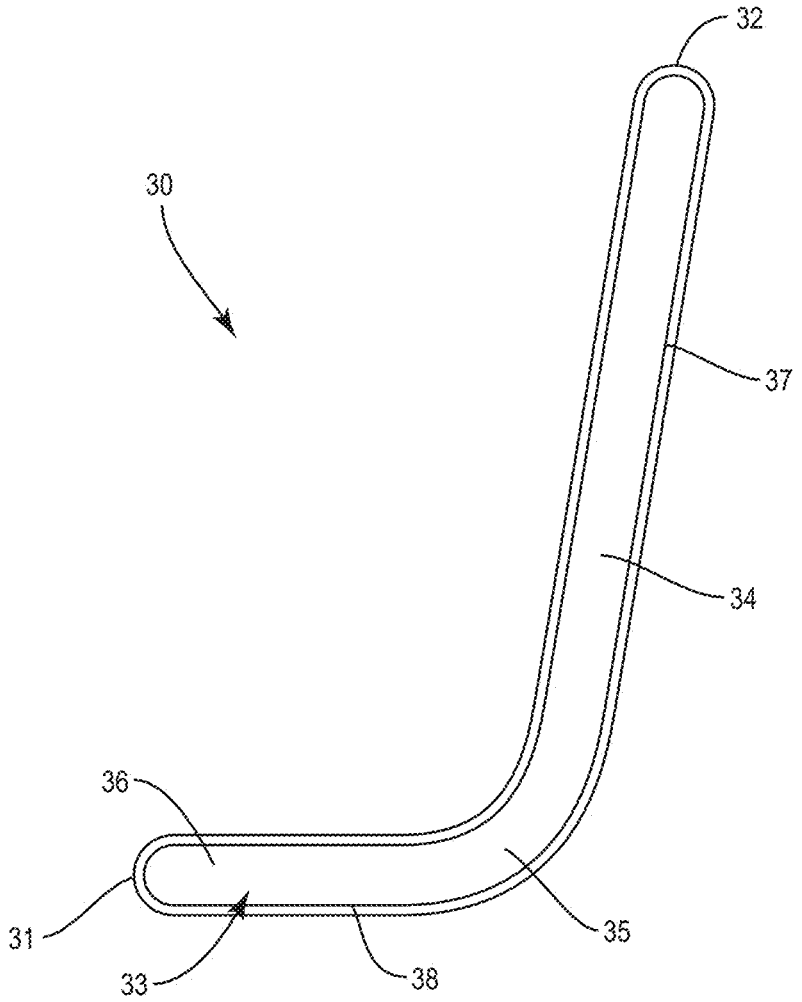
FIG. 4 is a schematic diagram of a heat pipe.

FIG. 4 schematically illustrates a heat pipe 30 that includes an elongated shape with a first end 31 and a second end 32. The heat pipe 30 is constructed from various materials that have a high thermal conductivity such as but not limited to copper, aluminum, and stainless steel. When mounted to the heat sink 20, the first end 31 is positioned outward from the heat sink 20 to be inserted into the apparatus 100. The second end 32 is mounted within the heat sink 20. The length of the heat pipe 30 that is mounted in the heat sink 20 can vary. In one example, about ½ of the heat pipe 30 is mounted in the heat sink 20. In another example, about ⅓ of the heat pipe 30 is mounted in the heat sink 20. In some examples, the heat pipes 30 are arranged in a straight row along the side 22 of the heat sink 20. The heat pipes 30 are oriented in the same manner within the heat sink 20 and at the same vertical level within the heat sink 20. This positioning provides for the heat pipes 30 to operate efficiently and facilitates insertion of the heat pipes 30 into the apparatus 100 in the engaged position.

The heat pipes 30 can include a variety of different shapes and sizes. In one example as illustrated in FIG. 4, the heat pipe 30 has a pair of straight sections 37, 38 that are separated by an intermediate curved elbow. In some examples as illustrated in FIGS. 2A and 2B, the curved shape enables the second end 32 that is mounted in the heat sink 20 to be positioned vertically above the first end 31 when the heat pipe 30 is inserted into the apparatus 100. This vertical orientation promotes phase change of the working fluid 36 within the interior space 33 of the heat pipe 30. In other examples, the heat pipe 30 has other shapes, such as but not limited to substantially straight and an elbow with a sharp, acute angular shape. The heat pipes 30 further include various sectional shapes. In one example, the heat pipes 30 include a circular sectional shape. In another example, the heat pipes 30 include a flattened shape (e.g., elongated oval shape).

The heat pipes 30 include an enclosed interior space 33 that contains the working fluid 36. The interior space 33 also includes a vapor cavity 34 and a wick 35. A vacuum is created within the interior space 33 to seal the working fluid 36 and corresponding vapor, and to facilitate the vaporization and condensation process. When the first end 31 is inserted into and in contact with the apparatus 100, the working fluid 36 evaporates thereby absorbing latent heat in the process. The vapor from the evaporated working fluid 36 moves within the vapor cavity 34 towards the second end 32 which has a lower temperature. The vapor at and/or in proximity to the second end 32 condenses thereby releasing the heat and returns back to the fluid form. The fluid at the second end 32 returns towards the first end 31 through the wick 35 by the process of capillary action. In some examples, the elevated positioning of the second end 32 further facilitates movement of the working fluid 36 from the second end 32 towards the first end 31. The working fluid 36 can be selected from a variety of different substances, including but not limited to water, ethanol, and naphthalene.

In some examples, the first end 31 of the heat pipe 30 is inserted directly into the pocket 101 of the apparatus 100 and the heat pipe 30 directly contacts against the apparatus 100. In some examples, the first end 31 has a rounded shape to facilitate insertion into and movement along the pocket 101.

Figure 5:
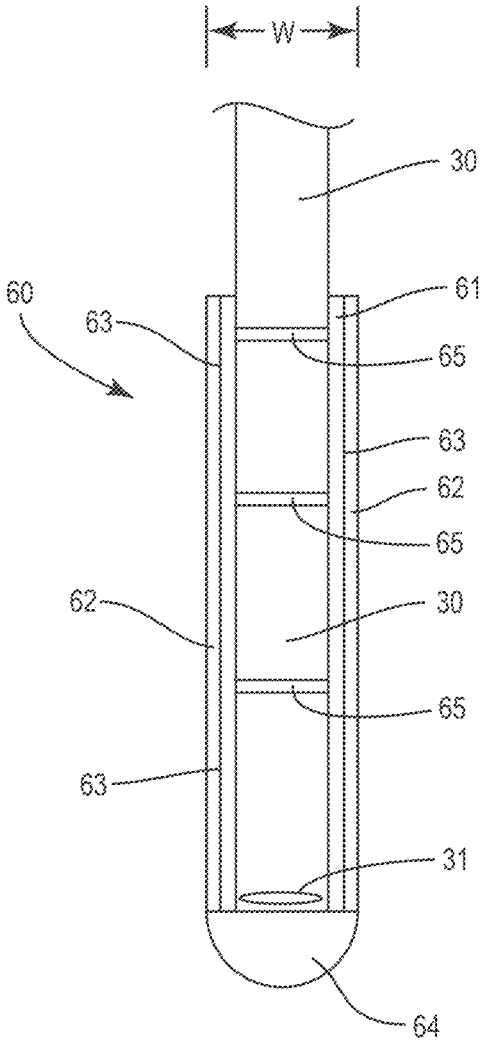
FIG. 5 is a schematic diagram of a thermal contact member mounted to an end of a heat pipe.

In some examples, a thermal contact member 60 is attached to the heat pipe 30 at the first end 31. As illustrated in FIG. 5, the thermal contact member 60 includes one or more inner members 61 that extend along opposing sides of the heat pipe 30. One or more braces 65 can extend between and connect together the inner members 61 to form a single unitary piece. One or more outer members 62 extend along the outer edges of the inner members 61. One or more biasing members 63 bias the outer members 62 laterally outward away from the inner members 61. Biasing members 63 can include various configurations including but not limited to coil springs, leaf springs, and flexible material. The biasing members 63 provide for the width W measured between the outer members 62 to be variable depending upon the size of the pocket 101. The thermal contact member 60 also includes a tip 64 at the distal end that is shaped to facilitate insertion into the pockets 101 of the apparatus 100. In one example, the tip 64 includes a rounded shape. In one example, the tip 64 includes a width that is less than the width of the outer members 62 to facilitate insertion.

Figure 6:
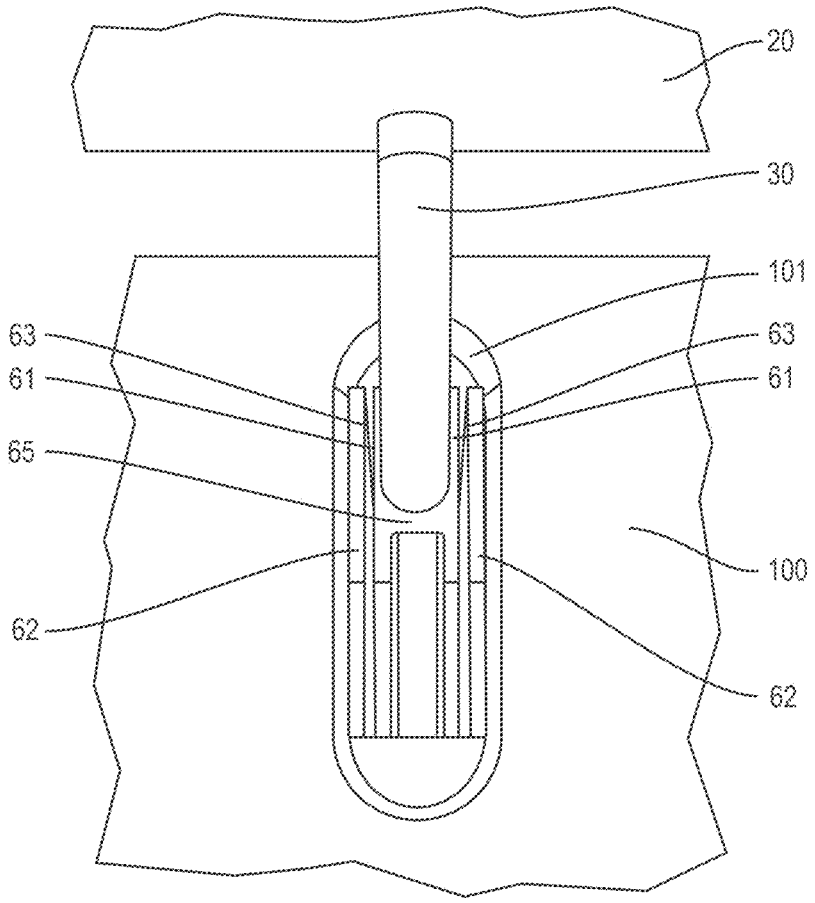
FIG. 6 is a rear view of a heat pipe inserted into a pocket of an apparatus.

The thermal contact member 60 is constructed from various materials that have a high thermal conductivity. Examples include but are not limited to copper, aluminum, and stainless steel. When inserted into the apparatus 100 as illustrated in FIG. 6, the outer members 62 contact against the apparatus 100. In some examples, the pocket 101 has a narrow width causing the outer members 62 to be biased inward. Heat from the apparatus 100 transfers to the thermal contact member 60 and then to the heat pipe 30.

The apparatus 100 is configured to receive the heat pipes 30 in the engaged position. In some examples as illustrated in FIGS. 2A and 2B, the apparatus 100 includes pockets 101 sized to receive the heat pipes 30. In some examples, the number of pockets 101 corresponds to the number of heat pipes 30. In other examples, the number of pockets 101 exceeds the number of heat pipes 30. The different pockets 101 can include the same or different shapes and/or sizes.

In some examples as illustrated in FIGS. 2A and 2B, the pockets 101 extend into a side 102 of the apparatus 100 and include a depth D. In some examples, the depth D extends substantially through the entire width of the apparatus 100. In other examples, the depth D is relatively small and extends into less than ½ the width of the apparatus 100. The depth D can be the same or different for each of the pockets 101.

In another example, one or more of the heat pipes 30 contact against an exterior side of the apparatus 100. These heat pipes 30 are not inserted into a pocket, but rather are just placed into contact with an exterior side of the apparatus 100.

A cooling system 150 as illustrated in FIGS. 2A and 2B includes the apparatus 100, heat sink 20, and heat pipes 30. The heat sink 20 and heat pipes 30 move between the engaged position and disengaged position to rapidly cool the apparatus 100. In some examples, the apparatus 100 is a tooling assembly configured to form a workpiece. The rapid cooling of the apparatus 100 provides for the apparatus 100 to operate efficiently during the formation of the workpiece and also enables a full working life.

Figure 7:
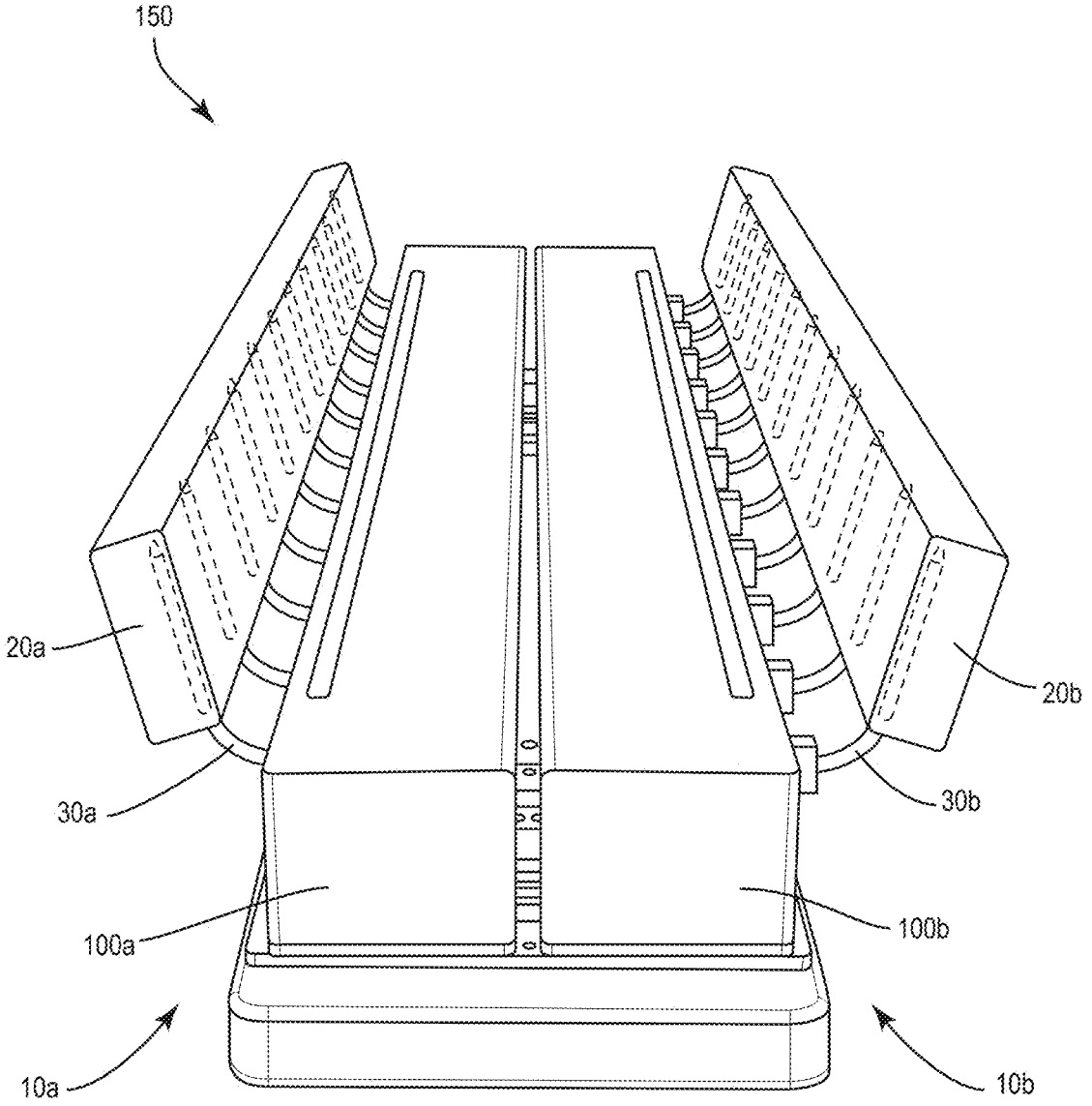
FIG. 7 is a perspective view of a cooling system having a pair of cooling assemblies.

In some examples as illustrated in FIGS. 2A and 2B, the cooling system 150 includes a single heat sink 20 with attached heat pipes 30 that engage with an apparatus 100. In other examples as illustrated in FIG. 7, the cooling system 150 includes two cooling assemblies 10*a*, 10*b*. The cooling assemblies 10*a*, 10*b* include a heat sink 20*a*, 20*b*, heat pipes 30*a*, 30*b*, and an apparatus 100*a*, 100*b* respectively. In some examples as illustrated in FIG. 7, the cooling system 150 is configured to form composite form stringers for an aircraft. The apparatus 100, 100*b* are form blocks that are part of a punch forming machine. The form blocks include pockets sized to receive the distal ends of the heat pipes 30*a*, 30*b*. In other examples, the cooling system 150 features three or more sets of apparatuses, heat sinks, and heat pipes.

In some examples as illustrated in FIG. 1, the heat pipes 30 translate laterally for engagement with the apparatus 100. In one specific example, the movement along the travel path shown by arrow A is substantially linear. In some examples, the number and spacing of the heat pipes 30 is substantially equal to the length of the apparatus 100 thus enabling for engagement along the length of the apparatus 100. The heat pipes 30 and heat sink 20 are configured to remove the heat through just contact with the apparatus 100 with no fluid connections needed with the apparatus 100. This allows for the apparatus 100 to decouple from the cooling assembly 10 to be conveyed down the production line.

Figure 8:
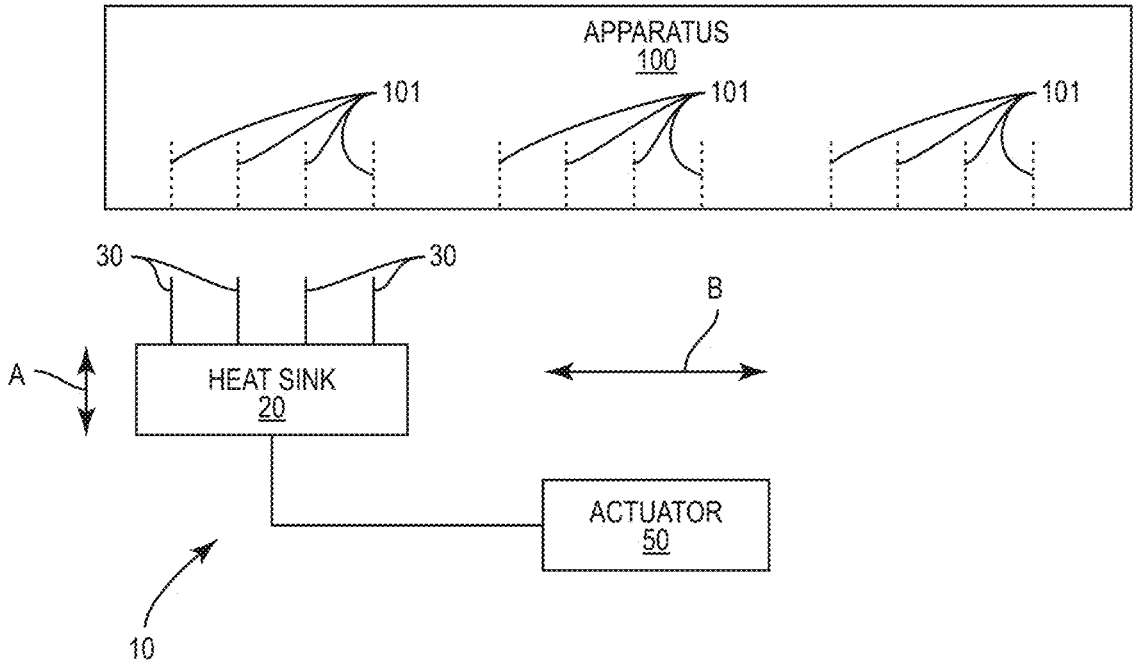
FIG. 8 is a schematic diagram of a cooling assembly that includes a heat sink, heat pipes, and an actuation mechanism configured for movement in lateral and longitudinal directions.

In another example as illustrated in FIG. 8, the cooling assembly 10 is configured to move laterally between the engaged and disengaged positions. In addition, the heat sink 20 and heat pipes 30 are also configured to translate longitudinally along the length as illustrated by arrow B to another section of the apparatus 100. Once positioned, the heat pipes 30 and heat sink 20 are again translated laterally into engagement with a second section. This process can continue to cool different sections along the length of the apparatus 100.

Figure 9:
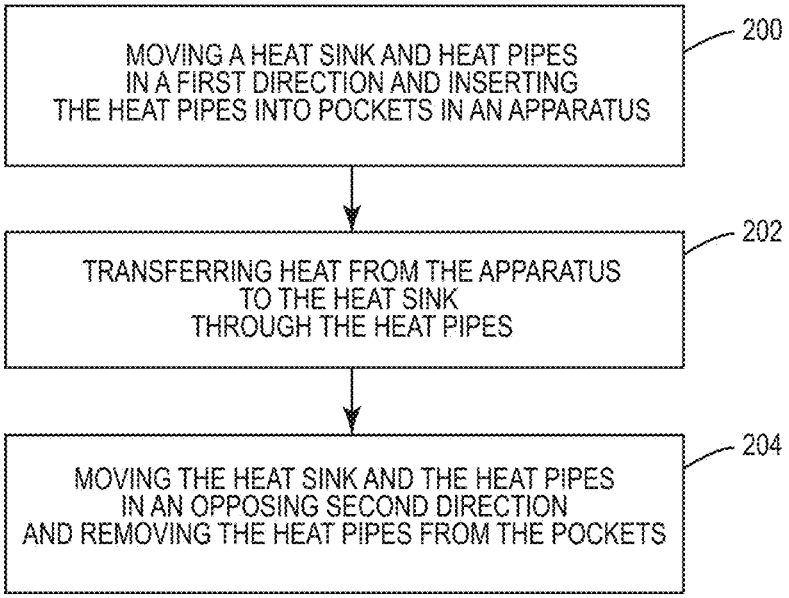
FIG. 9 is a flowchart diagram of a method of using a cooling system.

FIG. 9 illustrates a method of using a cooling system 150. The method includes moving a heat sink 20 and heat pipes 30 in a first direction and inserting the heat pipes 30 that are spaced apart along the heat sink 20 into pockets 101 in an apparatus 100 (block 200). Heat from the apparatus 100 is transferred to the heat sink 20 through the heat pipes 30 while the heat pipes 30 are inserted into the pockets 101 (block 202). The heat sink 20 and the heat pipes 30 are then moved in an opposing second direction to remove the heat pipes 30 from the pockets 101 (block 204).

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A heat pipe heat sink device configured to move into and out of contact with an apparatus that is to be cooled, the heat pipe heat sink device comprising:

a heat sink; and heat pipes connected to and that extend outward from the heat sink, each of the heat pipes comprising:

a first section that extends outward from the heat sink and that is shaped to be inserted into the apparatus;

a second section that is embedded within the heat sink; and thermal contact members mounted to ends of the heat pipes at the first sections and sized to be inserted into the apparatus, the thermal contact members comprising:

inner members that contact against the heat pipes;

outer members that are movably connected to and positioned outward from the inner members;

one or more biasing members connected to the inner members and the outer members; and wherein the outer members are biased outward from the inner members for the outer members to contact against the apparatus when the heat pipes and the thermal contact members are inserted into the apparatus.

2. The heat pipe heat sink device of claim 1, wherein the heat pipes are aligned in a straight row along the heat sink with each of the heat pipes mounted at a common vertical level within the heat sink.

3. The heat pipe heat sink device of claim 1, wherein the heat pipes comprise a first end in the first section and second end in the second section with the first end positioned vertically below the second end when the heat pipes are inserted into the apparatus.

4. The heat pipe heat sink device of claim 1, wherein the thermal contact members are constructed from thermally conductive material.

5. The heat pipe heat sink device of claim 4, wherein the thermal contact members are positioned on an exterior of the heat pipes to prevent the heat pipes from directly contacting against the apparatus when the heat pipes are moved in the first direction.

6. The heat pipe heat sink device of claim 1, wherein each of the heat pipes comprises an equal shape and size.

7. The heat pipe heat sink device of claim 1, wherein the thermal contact members comprise tips at distal ends, the tips comprising a rounded shape to facilitate insertion.

8. The heat pipe heat sink device of claim 7, wherein the tips comprise a smaller width than the outer members.

9. A heat pipe heat sink device configured to move into and out of contact with an apparatus that is to be cooled, the heat pipe heat sink comprising:

a heat sink comprising one or more conduits to move a first fluid within an interior of the heat sink;

heat pipes connected to and that extend outward from the heat sink, the heat pipes comprising a first end that extends outward from the heat sink and a second end positioned within the interior of the heat sink and vertically above the first end, the heat pipes further comprising an enclosed interior space that contains a working fluid; and thermal contact members mounted at the first ends of the heat pipes, the thermal contact members comprising one or more biasing members that compress to a smaller width when the heat pipes and the thermal contact members are inserted into the apparatus.

10. The heat pipe heat sink device of claim 9, wherein the heat pipes comprise a wick positioned within the interior space to facilitate movement of the working fluid from the second end towards the first end.

11. The heat pipe heat sink device of claim 9, wherein the thermal contact members comprise;

inner members mounted to the first ends of the heat pipes;

outer members mounted along outer sides of the inner members; and the one or more biasing members configured to bias the outer members outward away from the heat pipes.

12. The heat pipe heat sink device of claim 11, wherein the thermal contact members are mounted on an exterior of the heat pipes to prevent the heat pipes from directly contacting the apparatus in the engaged position.

13. The heat pipe heat sink device of claim 9, wherein each of the heat pipes comprises an identical shape and size.

14. The heat pipe heat sink device of claim 9, wherein the thermal contact members comprise tips with a rounded shape to facilitate insertion.

15. The heat pipe heat sink device of claim 14, wherein the tips comprise smaller width than the outer members.

16. A method of using the heat pipe heat sink device of claim 1, the method comprising:

moving the heat pipe heat sink device in a first direction and inserting the heat pipes that are spaced apart along the heat sink into pockets in the apparatus;

transferring heat from the apparatus to the heat sink through the heat pipes while the heat pipes are inserted into the pockets; and moving the heat pipe heat sink device in an opposing second direction and removing the heat pipes from the pockets.

17. The method of claim 16, further comprising compressing the thermal contact members mounted on the heat pipes while inserting the heat pipes into the pockets.

18. The method of claim 16, further comprising positioning second ends of the heat pipes vertically above first ends of the heat pipes while the first ends of the heat pipes are inserted into the pockets.

19. The method of claim 16, further comprising moving fluid in the heat sink directly into contact with an exterior of the heat pipes that are mounted in the heat sink while the heat pipes are inserted into the pockets.

20. The method of claim 16, further comprising:

translating the heat pipe heat sink device a distance along a length of the apparatus;

moving the cooling assembly in the first direction and inserting the heat pipes into additional pockets in the apparatus with the additional pockets spaced apart along the apparatus from the pockets; and transferring heat from the apparatus to the heat sink while the heat pipes are inserted into the additional pockets.

* * * * *